United States Patent [19]

Kageyama et al.

[11] Patent Number: 5,062,727

[45] Date of Patent: Nov. 5, 1991

[54] WRITING TOOL

[75] Inventors: Shubei Kageyama; Toshihiko Kageyama; Youichi Nakazato; Yoshihide Mitsuya, all of Kawagoeshi, Japan

[73] Assignee: Kotobuki & Co., Ltd., Kyoto, Japan

[21] Appl. No.: 274,297

[22] Filed: Nov. 21, 1988

Related U.S. Application Data

[62] Division of Ser. No. 255,101, Oct. 7, 1988.

[30] Foreign Application Priority Data

| | | | |
|---|---|---|---|
| Oct. 9, 1987 | [JP] | Japan | 62-155300[U] |
| Oct. 9, 1987 | [JP] | Japan | 62-155301[U] |
| Oct. 9, 1987 | [JP] | Japan | 62-155302[U] |
| Nov. 6, 1987 | [JP] | Japan | 62-170189[U] |
| Nov. 6, 1987 | [JP] | Japan | 62-170190[U] |
| May 18, 1988 | [JP] | Japan | 63-66194[U] |

[51] Int. Cl.[5] ..... B43K 29/02; B43K 21/16; B43K 21/08

[52] U.S. Cl. ..... 401/52; 401/65; 401/78

[58] Field of Search ..... 401/65, 67, 29, 52, 401/78, 116, 30, 31, 32, 16–19, 195; 15/431, 429, 433, 424, 427–434, 425, 426; 132/318

[56] References Cited

U.S. PATENT DOCUMENTS

| | | | |
|---|---|---|---|
| 364,916 | 6/1887 | Goldsmith | 401/52 |
| 1,372,354 | 3/1921 | Keeran | 401/52 |
| 1,461,437 | 7/1923 | Billman | 15/429 |
| 2,173,361 | 9/1939 | Gorrell | 401/52 |
| 2,198,335 | 4/1940 | Gaimari | 15/429 |
| 2,204,038 | 6/1940 | Findra | 15/429 |
| 2,287,794 | 6/1942 | Lynn | 401/52 |
| 2,293,993 | 8/1942 | Lynn | 15/429 |
| 2,525,229 | 10/1950 | Lynn | 401/65 |
| 2,532,037 | 11/1950 | Robbins | 15/429 |
| 4,352,580 | 10/1982 | Ando | 401/52 |
| 4,386,865 | 6/1983 | Kageyama | 401/67 |
| 4,904,101 | 2/1990 | Petterson | 401/52 |

FOREIGN PATENT DOCUMENTS

| | | |
|---|---|---|
| 57-132598 | 8/1982 | Japan . |
| 58-074584 | 5/1983 | Japan . |

*Primary Examiner*—Danton D. DeMille
*Assistant Examiner*—Richard Johnson
*Attorney, Agent, or Firm*—David O'Reilly

[57] ABSTRACT

This invention is to a writing tool such as mechanical pencil or a ballpoint pen in which a writing shaft having a head member is inserted in an outer sleeve in such a manner that the head member projects from the outer sleeve. A stair or step and a spiral groove are provided on the forward inner surface and the rearward inner surface of a tubular cap, respectively, with an inside diameter of the rear part of the spiral groove being larger. A bearing part is brought into contact with a lead tank provided inside a forward art of the tubular part so that the forward part of the outer sleeve is movable in the axial direction and is locked in the turning direction against a rearward inner surface of the outer sleeve. The rearward part of the tubular body is provided with a slit, holding pieces of a stick-shaped object holder slidably inserted in said slit. A stick-shaped object is held by the holding pieces, and the projection is provided on each holder engaged with the spiral groove of the tubular cap.

4 Claims, 12 Drawing Sheets

WRITING TOOL

This application is a division of application Ser. No. 07/255,101 filed Oct. 7, 1988.

BACKGROUND OF THE INVENTION

The present invention relates to a mechanical pencil in which an eraser can be drawn out from the rear end of a tubular cap by turning the tubular cap and a lead can be extended from a head member.

The present invention relates to an eraser holder of the extended type which, by turning a tubular cap against a tubular body an eraser holder can be slid so that the eraser held by two holding pieces can be extended in the direction turned.

Further, the present invention relates to a mechanical pencil of the knock-type in which a lead can be extended from a head member by a knocking operation. In particular the invention relates to a mechanical pencil in which a space corresponding to a knocking width is formed between an outer sleeve and a cap by a turning operation in one direction so that a knocking action can be performed, while a rod-shaped object can be extended from a rearward end of the cap by the turning operation of the cap in a reverse direction.

Furthermore, the present invention relates to a mechanical pencil of the knock-type in which a lead can be extended from a head member by a knocking operation. In particular the invention relates to a mechanical pencil in which a space corresponding to a knocking width is formed between an outer sleeve and a cap during a turning operation in one direction so that knocking can be performed while a rod-shaped object can be extended from a rearward end of the cap by a turning operation of the cap in the same direction.

Furthermore, the present invention relates to mechanical pencil in which a stick-shaped object, such as an eraser, lead crayon, a pastel, chalk, rouge, or eyebrow pencil lead, can be extended from the rear end of a tubular body and lead can be extended from a head member.

The usual mechanical pencil is constructed so that an eraser can be used by removing a knocking cap from an eraser holder on a lead container in a writing shaft and lead can be extended from the head member by knocking the knock cap attached on the eraser holder when the eraser is not in use.

However, in the above usual instance, because the eraser cannot be easily extended, whenever an eraser was worn out, troublesome effort was needed. An eraser supporter was taken out of an eraser holder, the eraser supporter was opened, the eraser withdrawn to the amount of worn out eraser, and the eraser supporter reinserted in the eraser holder and set in place by closing the holder.

Further, the mechanical pencil has an eraser holder in which the eraser supporter is an eraser held by being pressed thereon, attachable and detachably inserted in the eraser holding tubular part.

However, in the above usual instance, wherever the eraser is worn out, troublesome effort was needed in which an eraser supporter was taken out of the eraser holding tubular part, the eraser supporter opened, the eraser withdrawn to the amount of worn out eraser, and the eraser supporter reinserted in the eraser holding tubular part and set by closing the eraser supporter.

Furthermore, in the usual mechanical pencil, a space corresponding to a knocking width is provided between an outer sleeve and an cap so that a writing shaft can be extended from a head member by moving the writing shaft with the knocking cap while for erasing the cap can be removed from the mechanical pencil and the eraser can be exposed.

However, in the above usual instance, as the space corresponding to the knocking width is provided between the outer sleeve and the cap, erasing cannot be smoothly done because a force applied on the eraser causes the eraser to sink into the outer sleeve against the spring force and the external appearance cannot be attractive.

Further, the usual mechanical pencil is constructed so the the eraser can be used by removing the knocking cap from an eraser holder on the lead container of a writing shaft and the lead can be drawn out from the head member by knocking the knock cap attached on the eraser holder when the eraser is not in use.

However, in the above usual instance, because the eraser cannot be extended, whenever the eraser was worn out, the troublesome effort was necessary of taking an eraser supporter out from the eraser holder, opening the eraser supporter, withdrawing the eraser to the amount worn out, and reinserting the eraser supporter in the eraser holder and setting it by closing the eraser supporter.

BRIEF SUMMARY OF THE INVENTION

It is the primary object of this invention to provide a writing tool wherein a writing shaft having a head member is inserted in an outer sleeve in such a manner that the head member projects from the outer sleeve. A lead container of the writing shaft has a structure that allows said lead container to move in an axial direction and be locked in the turning direction against an inner surface of the outer sleeve. A tubular cap is provided with a tubular part which engaged the lead container so as to be rotatable and able to be attached and detached, with a spiral groove formed on an inner surface of the tubular cap. A projecting part of an eraser holder having an eraser engages with the spiral groove, and is provided with a tubular body which is rotatable in the axial direction but can be locked in the turning direction against a rear portion of the lead part.

According to this construction, because the tubular body of the eraser holder is movable in the axial direction and locked in the turning direction, turning of the tubular cap makes the eraser holder projecting part engage the spiral groove and move along the spiral groove of the tubular cap being turned in the axial direction so that the eraser can be extended from a rear end of the tubular cap or drawn therein according to the direction turned.

Further, because the lead container of the writing shaft is movable in an axial direction and locked in a turning direction, knocking on the rear end of the tubular cap makes the tubular part of the tubular cap and the lead tank move forward or rearward against the spring by the spring force so that lead can be extended from the head member by opening and shutting of a chuck in the same manner as with known mechanical pencils.

It is a further object of this invention to provide a writing tool with an eraser holder wherein an annular projection and spiral groove are provided on a tubular cap, a slit is formed in a tubular body having a retaining part engaged with the annular projection, and a holding piece of an eraser holder is slidably inserted in the slit so that the holding piece is directed rearward. An eraser is held by the holding piece, and a projection is provided on the holding piece engaged with the spiral groove of the tubular cap.

Because the projections provided on the holding pieces is inserted in the spiral groove of the tubular cap, turning the tubular cap against the tubular body makes the eraser holder travel in a guided axial direction along the slit of the tubular body receiving the inserted holding pieces so that the eraser can be extended or drawn into the tubular body according to the direction turned.

It is a further object of this invention to provide a writing tool wherein the writing shaft has a head member inserted in an outer sleeve in a manner allowing the head member to project from the outer sleeve. A annular projection and spiral groove are provided on the forward inner surface and the rearward inner surface of the tubular cap, respectively, and a retaining part is engaged with said tubular projection provided on an outer surface of a tubular body. A bearing part is brought into contact with a lead container provided inside a part of the tubular part positioned forward of said retaining part so that the forward part is movable in the axial direction and is locked in the turning direction against the rearward inner surface of the outer sleeve. A slit is provided on the rear part of the tubular body, with an eraser holder slidably inserted in said slit.

According to this construction, when the tubular cap is turned, because the forward part of the tubular body is movable in the axial direction and is locked in the turning direction against the rearward part of the outer sleeve, and also because the eraser holder is slidably inserted into the slit of a rearward part of the tubular body, the eraser holder can be moved in the axial direction while being guided along the slit in the tubular body so that the eraser provided on the eraser holder can be drawn in and extended out of the tubular body.

Further, when the rear end of the tubular body is knocked, the lead container is brought into contact with the bearing part of the tubular body with the tubular cap moved forward or rearward against the spring or with the spring force so that lead can be drawn in and extended out of the head member by opening and shutting of a chuck in the same manner as in known mechanical pencils.

It is a further object of this invention to provide a writing tool wherein a writing sleeve is inserted into an outer sleeve, and the forward part of a tubular body is provided with a worm-shaped way. A tubular lead pipe receiver having on its outer surface a retaining part engages the worm-shaped way on the lead pipe of the writing shaft so that the tubular lead pipe holder is movable in the axial direction and is locked in the turning direction against an inner surface of the outer sleeve. The inner surface of the tubular body is provided with a bearing part for the tubular lead pipe holder. The rearward part of the tubular part is provided with an axial slit, and a stick-shaped object can be held and guided along the slit. The stick-shaped object holder is provided with a projection inserted into a spiral groove formed in the same direction as the above worm-shaped way on the inner surface of a tubular cap, and the tubular body is inserted into the tubular cap.

When the tubular cap is turned in one direction, the projection engaged with the spiral groove of the cap is brought into contact with the forward end of the spiral groove so that the stick-shaped object cannot be turned. Therefore the tubular body can be turned through the holder. Because the tubular lead pipe holder retaining part inserted into the worm-shaped way provided at the forward part of the tubular body is movable in the axial direction and is locked in the turning direction against the inner surface of the outer sleeve, turning of the tubular cap makes the retaining part move relatively along the worm-shaped way so that the tubular body moves backward against the tubular lead pipe holder. As a result, a space corresponding to a knocking width is formed between the outer sleeve and the tubular cap so that knocking is possible. When the rearward end of the tubular body is knocked, the tubular cap, the tubular lead pipe holder and the lead pipe of the writing shaft move forward and lead is extended from the head member in the same manner as the usual mechanical pencil.

When carrying the mechanical pencil, or when the mechanical pencil is not in use, the space corresponding to the knocking width is closed by turning the tubular cap in the reverse direction so that the tubular cap is brought into contact with the outer sleeve. In this condition, even if the tubular cap is turned in the reverse direction, a space is not formed between the tubular cap and the outer sleeve, and the retaining part of the tubular lead pipe holder contacts the end of the worm-shaped way so that the tubular body cannot turn. Therefore turning the tubular cap in the reverse direction makes the stick-shaped object holder moves rearward along the spiral groove of the tubular cap so that only the stick-shaped object can project. As the space between the outer sleeve and the tubular cap can be eliminated when the stick-shaped object is in use, a knocking action cannot occur. Therefore, even if a strong force is applied to the stick-shaped object, it will not retract.

After the stick-shaped object is used, it is possible to withdraw the stick-shaped object held by the stick-shaped holder by turning the tubular cap in one direction in the same manner as in the case after a knocking operation is finished.

It is a further object of this invention to provide a writing tool wherein a writing sleeve is inserted into an outer sleeve, a forward part of a tubular body is provided with a worm-shaped way, and a tubular lead pipe receiver having on its outer surface a retaining part engaged with the worm-shaped way is placed on the lead pipe of the writing shaft so that the tubular end pipe holder is movable in the axial direction and is locked in the turning direction against an inner surface of the outer sleeve. The inner surface of the tubular body is provided with a bearing part for the tubular pipe holder, and the rearward part of the tubular part is provided with an axial slit. A stick-shaped object is slidably inserted into the rearward part of the tubular body so that the stick-shaped object can be held and guided along the slit. The stick-shaped object holder is provided with a projection inserted into a spiral groove formed in a direction reverse to the above worm-shaped way on an inner surface of a tubular cap, and the tubular body is inserted into the tubular cap.

When the tubular cap is turned in one direction, the projection engages the spiral groove of the cap and is brought into contact with the forward end of the spiral groove so that the stick-shaped object cannot be turned through the holder and because the tubular body can be turned through the holder. The tubular lead pipe holder retaining part inserted into the worm-shaped way provided at the forward part of the tubular body is movable in the axial direction and is locked in the turning direction against the inner surface of the outer sleeve. Turning the tubular cap makes the retaining part move relatively along the worm-shaped way so that the tubular body moves backward against the tubular lead pipe holder. As a result, a space corresponding to a knocking width is formed between the outer sleeve and the tubular cap so that a knocking action is possible. When the rearward end of the tubular body is knocked, the tubular cap, the tubular lead pipe holder and the lead pipe of the writing shaft move forward extending a lead from the head member in the same manner as in the usual mechanical pencil.

When carrying the mechanical pencil, or when the mechanical pencil is not in use, the space corresponding to the knocking width is closed by turning the tubular cap in the reverse direction so that the tubular cap is brought into contact with the outer sleeve. In this condition, even if the tubular cap is turned in one direction, a space is formed between the tubular cap and the outer sleeve, and further turning the tubular cap in the same direction, brings the retaining part off the tubular lead pipe holder into contact with an end of the worm-shaped way so that the tubular body cannot be turned. Therefore, turning the tubular cap in the reverse direction makes the stick-shaped object holder move rearward along the spiral groove in the tubular cap so that only the stick-shaped object can project. As the space between the outer sleeve and the tubular cap can be eliminated by turning the tubular cap in the reverse direction when the stick-shaped object is used, and the knocking action cannot occur. Therefore, even if a strong force is applied to the stick-shaped object, it is not possible for the stick-shaped object to retract.

After the stick-shaped object is used, it is possible that the stick-shaped object held with the stick-shaped holder can be withdrawn by turning the tubular cap in a reverse direction and thereafter further turning it in the reverse direction.

It is a further object of this invention to provide a writing tool wherein a writing shaft has a head member inserted in an outer sleeve in a manner allowing the head member to project from the outer sleeve. A stair or step and a spiral groove are provided on the forward inner surface and the rearward inner surface of a tubular cap, respectively, and the inside diameter of the rear part of the spiral groove is larger. A bearing part is brought into contact with a lead container provided inside a forward part of the tubular part so that the forward part of the outer sleeve is movable in the axial direction and is locked in the turning direction against a rearward inner surface of the outer sleeve. The rearward part of the tubular body is provided with a slit, and holding pieces for a stick-shaped object holder are slidably inserted in said slit. A stick-shaped object is held by the holding pieces, and the projection provided on each holding piece is engaged with the spiral groove of the tubular cap.

According to this construction, when the tubular cap is turned, because the forward part of the tubular body is movable in the axial direction and is locked in the turning direction against the rearward part of the outer sleeve, and also because the stick-shaped object holder is slidably inserted into the slit of the rearward part of the tubular body with the projections of the holding pieces engaged with the spiral groove of the tubular cap, the stick-shaped object holder can move in the axial direction guided along the slit of the tubular body so that a stick-shaped object can be drawn in and extended out of the tubular body.

When the eraser is consumed, the stick-shaped object holder is moved backward. The two holding pieces of the stick-shaped holder are largely deformed outward, because the inside diameter is larger. Therefore, the eraser is released from the holding pieces so that the eraser can be easily removed from between the two holding pieces. When the tubular cap is turned to move the stick-shaped object holder forward, the projection engaged with the spiral groove leaves the large inside diameter part of the rear part of the spiral groove, and the two holding pieces are held by the tubular cap, thus holding the eraser.

Further, when the rear end of the tubular body is knocked, the lead container brought into contact with the bearing part of the tubular body with the tubular cap, can be moved forward or rearward against a spring or with a spring force so that lead can be drawn in and extended out of the head member by opening and shutting of a chuck in the same manner as in the known mechanical pencil.

The above and other features of this invention will be fully understood from the following detailed description and the accompanying drawings, in which:

DETAILED DESCRIPTION OF THE INVENTION

Figure 1:
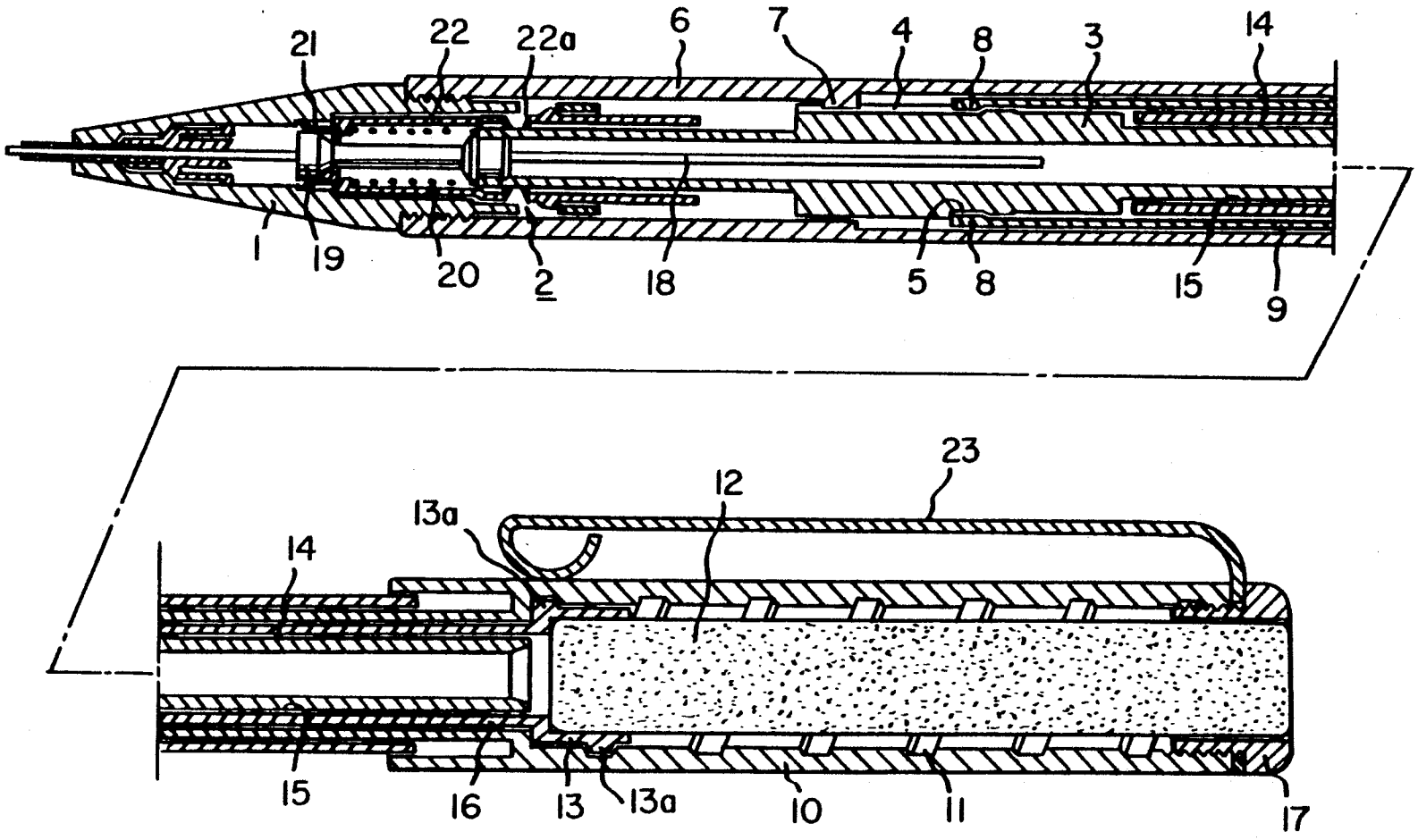
FIG. 1 is a vertical sectional view showing a first embodiment of mechanical pencil according to the present invention.

A first example according to the present invention is illustrated with reference to FIG. 1.

A writing shaft 2 having a head member is comprised of a chuck 19, spring 20, chuck ring 21, sleeve with a cushion part 22*a*, and a lead container 3 connected to chuck 19.

An axial retaining groove 4 and annular retaining recess 5 is provided on the outer surface of lead container 3. Head member 1 is screwed on the forward part of outer sleeve 1. Writing shaft 2 is inserted in outer sleeve 6 in a manner that has head member 1 projecting from the outer sleeve, and projection 7 engages an axial retaining groove 4 provided on the inner side of outer sleeve 6.

Tubular cap 10 is formed integrally with tubular part 9 inserted in outer sleeve 6 and has on the inner surface of its head portion a projection 8 engaged with annular retaining recess 5. Spiral groove 11 is formed on the inner surface of tubular cap 10. Projection 8 may be provided on the inner surface of the head portion of tubular part 9 over the whole circumference, and one or more projections may be provided. Their number is optional.

The present example has a construction in which projection 7 is provided an inner surface of outer sleeve 6 and axial retaining groove 4 is provided on the outer surface of lead container 3 so that the lead container 3 is movable in the axial direction and is locked in the turning direction against the inner surface of outer sleeve 6 by the engagement of projection 7 with axial retaining groove 4. However, the present invention is not restricted to such a construction. For example, the present invention may have the construction of a key groove and a key.

Further, the present example has a construction in which annular retaining recess 5 is provided on the lead container and projection 8 is provided on the tubular part of tubular cap 10 so that tubular portion 9 is engages with annular retaining recess 5 to be rotatable against lead container 3 and able to be attached and detached. However, of course, the present invention is not restricted to such a construction.

Projection 13*a* on eraser holder 13 holding eraser 18 is engaged with spiral groove 11 and tubular body 16 is formed integrally with eraser holder 13 has on an inner surface thereof polygonal part 15 in which polygonal part 14 formed on the outer surface of the rear portion of lead container 3 is inserted. Therefore, polygonal part 15 on the inner surface of tubular body 16 of eraser holder 13 is movable in the axial direction and is locked in the tuning direction against polygonal part 14 of the rearward and outer surface of lead container 3. However, means for locking tubular body 16 of eraser holder 13 against the rear portion of lead container 3 so that the former is movable in the axial direction and is locked in the turning direction against the latter do not need to be restricted to polygonal parts 14, 15. The present invention may have means consisting of a key groove and a key.

Ring-shaped top screw 17 is screwed on the rear end of tubular cap 10. Top screw 17 functions to prevent eraser holder 13 from slipping and also to hold the annular base of clip 23.

In the above construction, polygonal part 14 formed on the rearward and outer surface of lead tank is inserted in polygonal part 15 formed on the inner surface of tubular body 16 of eraser holder 13 so that tubular body 13 of the eraser holder 13 is movable in the axial direction and is locked against the rear portion of the lead container 3. Turning tubular cap 10 makes eraser holder 13 with projection 13*a* engaged with the spiral groove 11 move in an axial direction along spiral groove 11 so that eraser 12 can be drawn out form top screw 17 screwed on the rear portion of tubular cap 10 according to the direction turned.

Further, because projection 8 of tubular part 9 of tubular cap 10 is engaged with annular retaining recess 5 of lead container 3 and the former is retained on the latter, knocking top screw 10 screwed on the rear end of tubular cap 10 makes tubular part 9 of tubular cap 10 and lead container 3 move forward or rearward against the spring 20 or with the spring force so that lead 18 can be extended from head member 1 with the opening and shutting of chuck 19 in the same manner as in known mechanical pencils.

As in the above-mentioned, according to the present invention, eraser 12 can be extended from the rear end of tubular cap 10 by the needed amount so that erasing can be performed, and can be withdrawn into the rear end of tubular cap 10 when the eraser is not used. Extending and drawing in of eraser 12 can be simply performed with the turning operation. Therefore, the known troublesome effort need not be carried out repeatedly.

Figure 2:
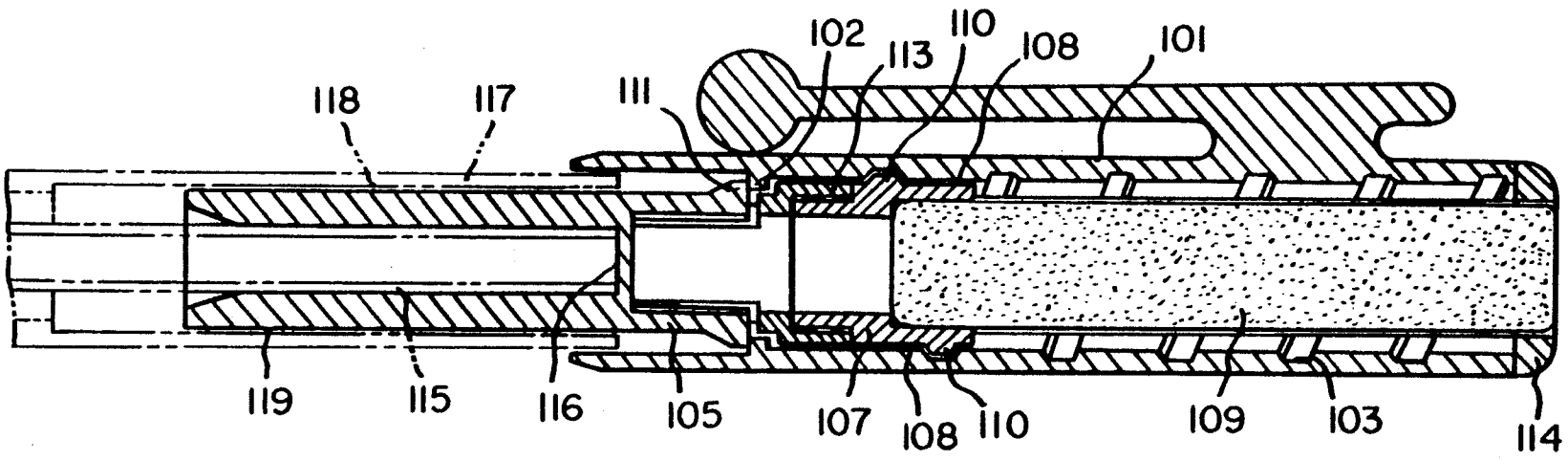
FIG. 2 is a vertical section view showing a second embodiment of an eraser holder according to the present invention.
Figure 3:
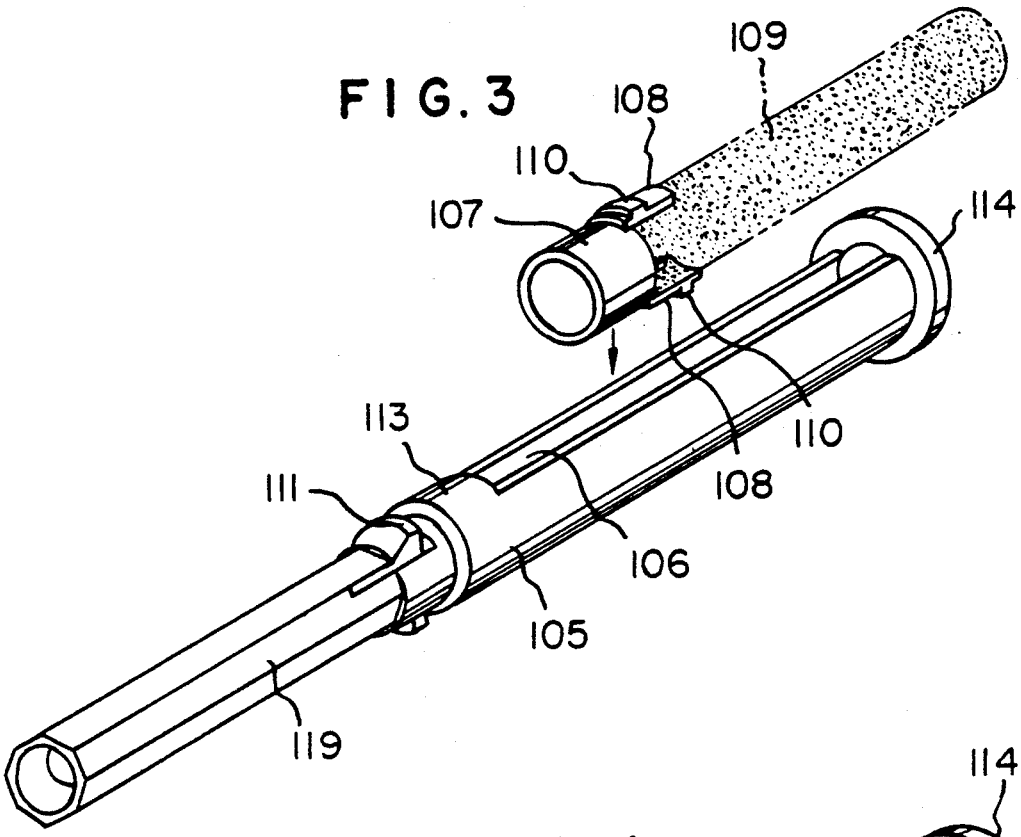
FIG. 3 is a partial exploded view of the embodiment of FIG. 2.
Figure 4:
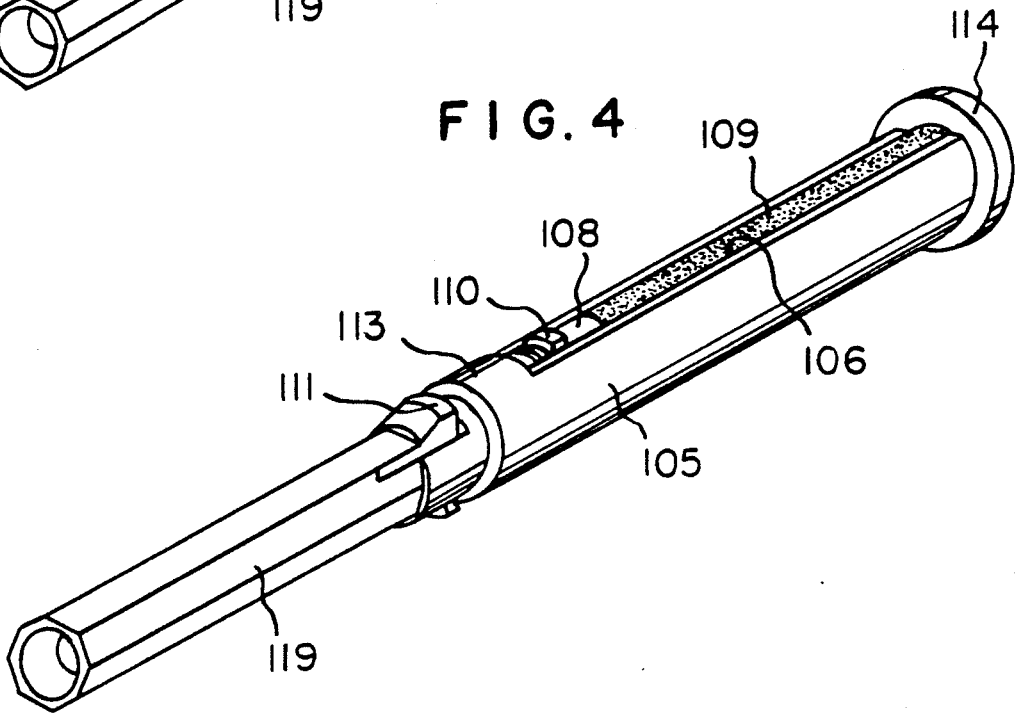
FIG. 4 is a section view showing an eraser and holder inserted into a slit of a tubular body according to the invention.

A second example according to the present device is illustrated with reference to FIGS. 2 to 4.

Tubular cap 101 has on the forward inner surface step 102 provided, while on the rearward inner surface spiral groove 103 is provided. Tubular body 105 is inserted from the rear end of tubular cap 101. The outer surface of a nearly central part of tubular body 105 has a projecting piece 111 engaged with step 102 while opposing part of the rearward part of tubular body 105 is provided with slit 106. Projecting piece 111 is formed by cutting and engages with step 102 of tubular cap 101.

Two holding pieces 108 of eraser holder 107 are slidably inserted in slit 106 so as to be directed backward. Eraser 109 is held between holding pieces 108. Annular stoppers 113, 114 respectively on eraser holder 107 are formed at the forward and rear ends of slit 106. Accordingly, eraser holder 107 can be move in the axial direction until eraser holder 107 comes into contact with annular stoppers 113, 114 at the forward and rear ends of slit 106. Further, spiral groove 103 of tubular cap 101 are engaged with projections 110 provided on holding pieces 108.

A method of assembling the eraser holder of the extending system according to the invention, having the above-mentioned construction is illustrated hereafter.

First, as both sides of the slit of the tubular body 105 are bent toward the outside, eraser holder 107 is inserted so as to be directed backward, and both holding pieces 108 are slidably inserted in both slits 106. Then, eraser 109 is inserted from the rear end of the tubular body 105 so as to be held by both holding pieces. Tubular body 105 is inserted from the rear end of tubular cap 101 whereby projecting pieces 111 being bent inward get over the step 102 of tubular cap 101 completing the assembly.

Holding eraser 109 with both holding pieces 108 may be carried out after tubular body 105 is attached to tubular cap 101. When assembling is completed, annular stopper 114 comes into contact with the rear end of tubular cap 101. Of course the size of the parts should be determined so that the above state is obtained.

Then, the function of the eraser holder according to the invention is illustrated. When eraser 109 is not in use, as shown in FIG. 2, eraser 109 comes into contact with annular stopper 113 of the forward part of eraser holder 107, and the top of eraser 109 just coincides with the end surface of annular stopper 114 on the rear part of tubular body 105.

In this condition, because projections 110 provided on holding pieces 108 of the eraser holder are inserted in spiral grooves 103 of tubular cap 101, turning tubular cap 101 against tubular body 105 makes eraser holder 107 move in an axial direction. As eraser holder 107 is guided along both slits 106 of the tubular body with which both holding pieces 108 are engaged eraser 109 held by two holding pieces of eraser holder 107 can be extended and drawn in of the tubular body according to the direction of turning.

Extending of eraser 109 can be performed by turning tubular cap 101 to an amount equal to the worn out eraser so that eraser holder 107 can be moved in the axial direction, or the right direction. After the eraser has been used, reverse-turning of tubular cap 101 makes eraser holder 107 move left drawing the eraser in.

Further, because eraser 109 is held by two holding pieces 108 of eraser holder 107 inserted in tubular body 105 on the side of slits and holding pieces 108 are slidably engaged with slits 106, eraser 109 is held by two holding pieces 108 and parts of tubular body 105 on the two sides of the slits 106 and annular stopper 104. Therefore eraser 109 cannot become unsteady when erasing. Besides, as the whole of eraser 109 can be formed with the same diameter, there is no need to thin a part of the eraser brought into contact with the holding part. Further, because eraser 109 with much the same size as the inner diameter of the part of the slit side tubular body 105 can be used, there is no need to make the scale of tubular cap 101 thicker. Therefore a maximum thickness eraser can be used.

In case of an eraser holder according to the invention being applied to a mechanical pencil, the forward part of tubular body 105 is made thinner than the rearward portion of the slit. Bearing part 116 is brought into contact with the rear end of lead container 115 provided on the forward inner surface, and polygonal part 119 is inserted in polygonal part 118 formed on the inner surface of the outer sleeve 117 formed on the forward outer surface of tubular body 105.

In this construction, because polygonal part 119 of the forward outer surface of tubular body 105 is inserted in the forward polygonal part 118 on the inner surface of outer sleeve 117, tubular body 105 is movable in the axial direction and is locked in the turning direction. Further because the lead container 115 is brought into contact with bearing plate 116, tubular body 106, and tubular cap 101 attached thereto are moved forward or rearward against the spring or spring force in the same manner as in known mechanical pencils the lead can be extended from the head member of the mechanical pencil with the opening and shutting of the chuck. Further when tubular cap 101 is turned, extending or retracting of eraser 109 can be carried out.

As in the above-mentioned, according to the device, eraser holder 107 can be moved in the axial direction with tubular cap 101 being turned against tubular body 105 so that the eraser can be drawn in and extended out of tubular body 105. Therefore, erasing can be performed by extending out eraser 109 the necessary amount. When the eraser is not in use it can be drawn in. Thus extending or retracting can be simply performed with a turning operation. Therefore, there is no need to repeatedly do the troublesome work as in the usual instance.

Figure 6:
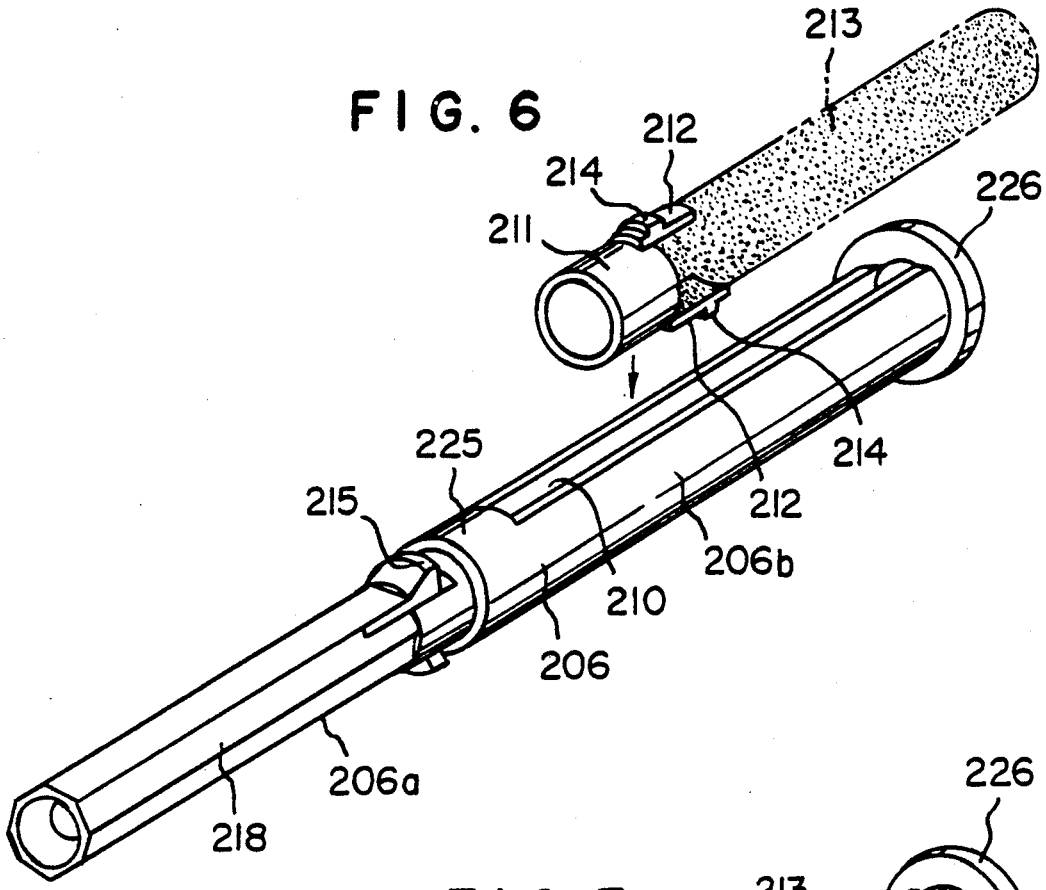
FIG. 6 is a partial exploded perspective view of the embodiment of FIG. 5.
Figure 7:
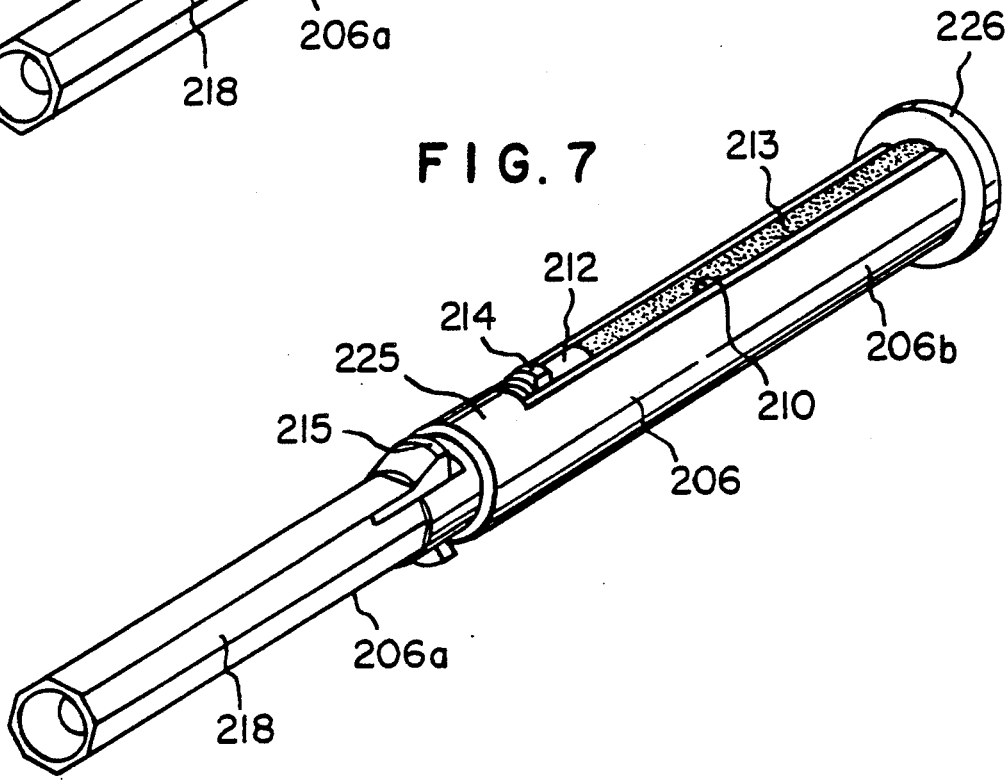
FIG. 7 is a perspective section showing an eraser and holder inserted into a slit of a tubular body according to the invention.

A third example according to the present invention is illustrated with reference to FIGS. 5 to 7.

In the drawings, writing shaft 202 comprises a chuck 221, a spring 220, a chuck ring 223, a sleeve 224 having a cushion part **224*a*, and lead tank 208 connected with chuck 221. Writing shaft 202 is provided in the outer sleeve 203 by screwing the head part of outer sleeve 203 in so that the head member 201 projects out of outer sleeve 206**.

Tubular cap 219 has a forward inner surface provided with step 204 while a rearward inner surface is provided with a spiral groove 205.

Tubular body 206 is inserted into the cap 219 from its rear end. The outer surface of tubular body 206 nearly in the center thereof is provided with step 204 engaging projecting piece 215 provided on tubular body 206 by cutting. Forward part **206*a* of tubular body 206 is provided with a retaining part, for example a bearing plate 209**.

A rear inner surface of outer sleeve 203 is formed with polygonal part 217 while an outer periphery of a forward part **206*a* of tubular body 206 is formed with polygonal part 218 which is inserted into polygonal part 217. Accordingly, forward part 206*a* of tubular body 206 is movable in the axial direction and is locked in the turning direction against the rear part of the outer sleeve. Means for locking forward part 206*a* of tubular body 206 however so as to be movable in the axial direction does not need to be restricted to means with polygonal parts 217, 218**, for example means with a key groove may be used.

Slits 210 are formed in the corresponding parts of rear part **206*a* of tubular body 206. Into slits 210, two holding pieces 212 of eraser holder 211 are slidable and directed rearward. Eraser 213 is held between two holding pieces 212. Projection 214 is provided on holding pieces 21 inserted in spiral groove 205 of tubular cap 219. Annular stoppers 225, 226 of eraser holder 211 are formed at the forward part and rearward part of slits 210. Therefore eraser holder 212 can be moved in the axial direction until eraser holder 211 is brought into contact with annular stoppers 225, 226 at the forward and rear parts of slit 210**.

A method of assembling the mechanical pencil having the above construction according to the invention is illustrated hereinafter.

First, as both sides of slit 210 of tubular body 206 are bent toward the outer side, eraser holder 211 is inserted from said slit 210 so that both holding pieces 212 are directed toward the rearward portion, and both holding pieces 208 are slidably inserted in both slits 206. Eraser 213 is inserted from the rear end of tubular body 206 so as to be held at both holding pieces. Tubular body 206 is inserted from the rear end of tubular cap 219 whereby projecting pieces 215 are bent toward the inside of the tubular cap and get over step 204 of tubular cap 219 and engages stop 204.

Holding of eraser 213 with both holding pieces 212 may be carried out after tubular body 206 is attached to tubular cap 219. When attachment of tubular body 206 to tubular cap 219 has ended, annular stopper 226 of tubular body 206 is brought into contact with the rear end of tubular cap 210. Of course the size of the parts should be determined so that the above state is obtained.

Thereafter, polygonal part 218 provided on the other surface of forward part 206*a* of the tubular body 206 is inserted into polygonal part 217 provided on the rearward inner surface, thereby the assembly of the mechanical pencil is completed. In this case, it should be apparent that the insertion is tightly done so that tubular body 206 does not slip out of the rear portion of outer sleeve 203.

The function of the eraser receiver according to the invention is illustrated hereinafter.

Figure 5:
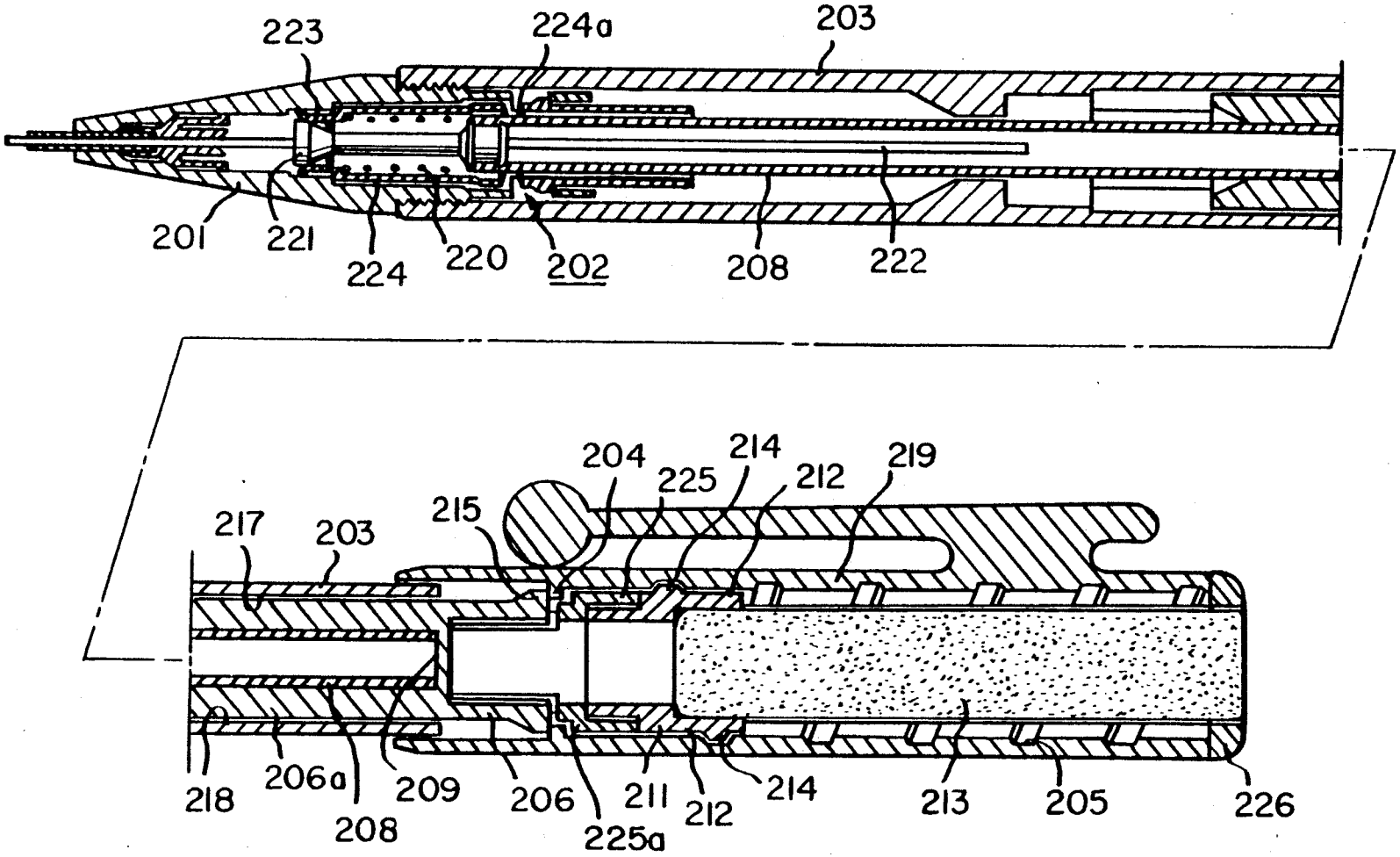
FIG. 5 is a vertical section showing a third embodiment of a mechanical pencil according to the invention.

When eraser 213 is not used, as shown in FIG. 5, eraser holder 211 is brought into contact with annular stopper 225 of the forward part of tubular body 206, and the top of eraser 213 just coincides with the end surface of annular stopper 226 on the rear part of tubular body 205.

In this condition, when tubular cap 219 is turned, because forward part 206*a* of tubular body 206 is movable in the axial direction and is locked in the turning direction against the rearward portion of outer sleeve 203, and projection 214 provided on holding piece 212 of eraser holder 211 is inserted into spiral groove 205 of tubular cap 219, eraser holder 211 moves in the axial direction guided along both slits 210 of tubular body 206. The two holding pieces 212 are inserted so that eraser 213 held by the two holding pieces 212 of eraser holder 211 can be drawn in and extended out of tubular body 206 according to the direction of turning.

Further, when the rear end of tubular body 206, with lead container 208 is brought into contact with the bearing plate 209, tubular cap 219 can be moved forward or rearward so that lead 222 can be extended from head member 201 against the action of spring 220 opening and shutting chuck 221 as in known mechanical pencils.

Extending eraser 213 can be performed by turning tubular cap 219 an amount equal to the worn out portion of the eraser in the right direction as in the example shown in the drawings. After use the eraser 213 can be withdrawn by turning in the reverse direction so that the eraser holder 211 is moved in the left direction.

As above-mentioned, eraser holder 211 can be moved in the axial direction by turning tubular cap 219 against other sleeve 203 and can be drawn in and extended out of tubular body 206 according to direction of turning. Therefore when the eraser is needed, it can be extended the necessary amount so that erasing can be performed while when the eraser is not in use it can be drawn in. Thus the drawing in and extending out of eraser 213 can be simply performed by rotating tubular cap 219. Therefore, the usual troublesome effort does not need to be repeatedly carried out. Further the numbers of parts are few, and the mechanical pencil according to the invention can be produced at a low price.

Figure 9:
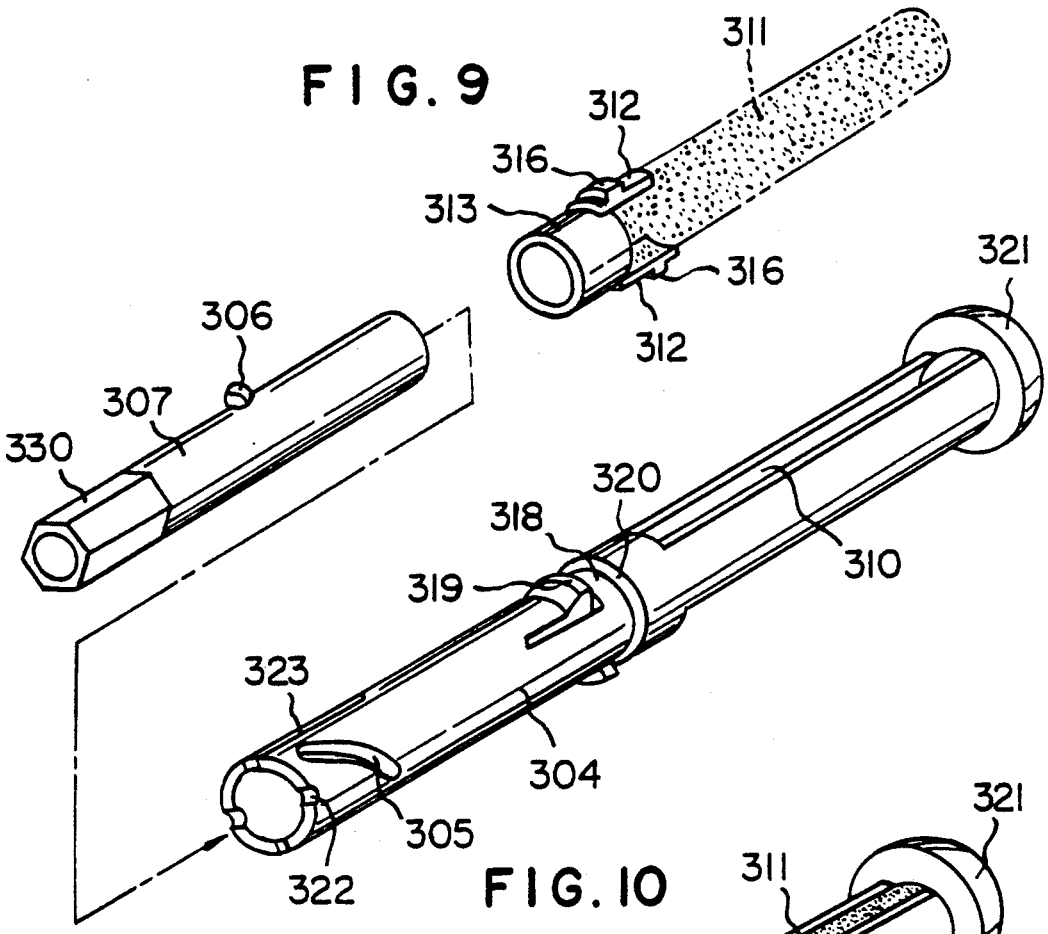
FIG. 9 is a partial exploded perspective view showing the essential parts of the present invention shown in FIG. 8.
Figure 10:
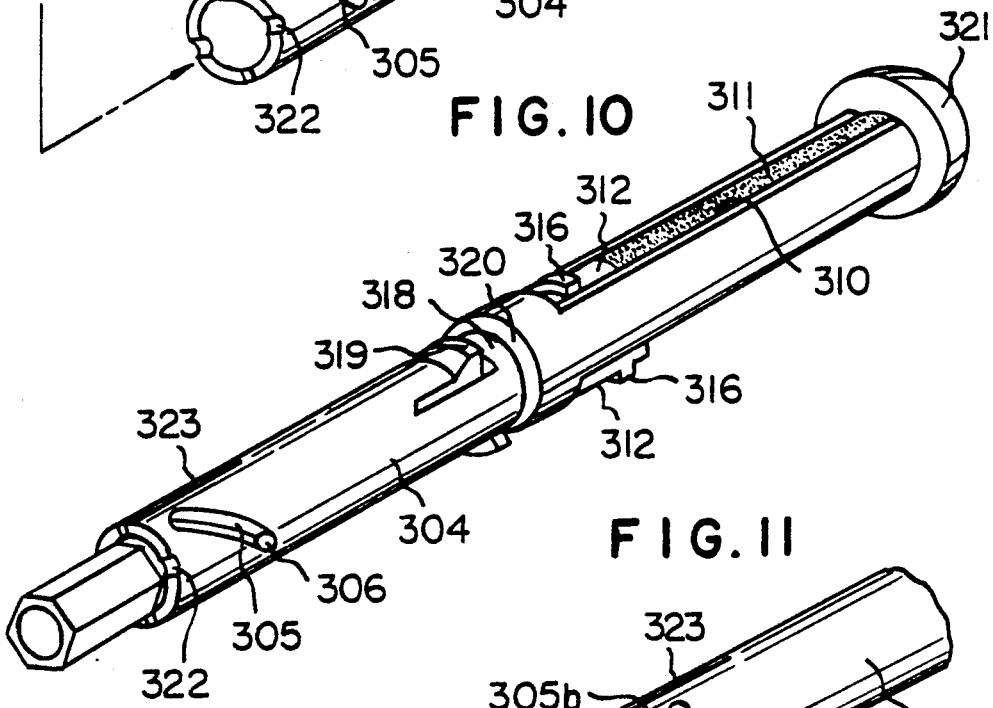
FIG. 10 is a perspective view showing the embodiment of FIG. 9 assembled.

A fourth example according to the present device is illustrate with references to FIG. 8 to 10 hereinafter.

Figure 8:
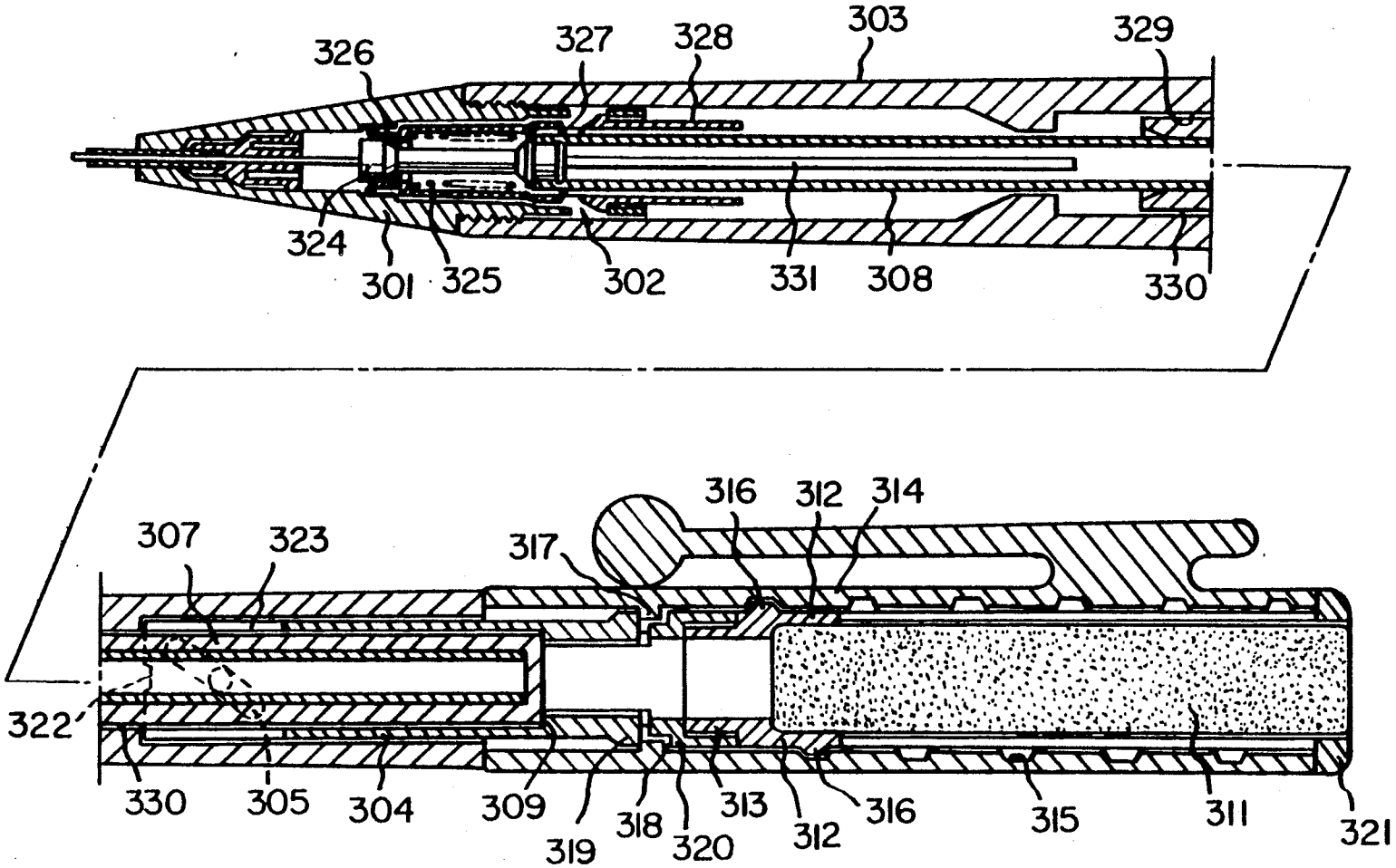
FIG. 8 is a section showing a fourth embodiment of a mechanical pencil according to the present invention.

In FIG. 8, a writing shaft 302 has a head member 301. Writing shaft 302 comprises chuck 324, spring 325, chuck ring 326, a sleeve with cushion 327, and lead pipe 308 connected to chuck 324. The writing shaft is provided in outer sleeve 303 by screwing the head part of outer sleeve 303 so that head member 31 projects.

The forward part of tubular body 304 is provided with worm-shaped way 305, and tubular lead pipe holder 307 having on its outer surface retaining part 306 engaging the worm-shaped way 305 may be a groove or slit. In the drawing, a worm-shaped way formed of a slit is shown. Both ends of worm-shaped way 305 corresponds to a starting point, and an end point of retaining part 306. The forward end portion of tubular body 304 is provided, as occasion demands, with one or more slits 323 whose forward end(s) is(are) opened. Guiding recess 322 is provided at the forward end of the tubular body so that engagement of retaining part 306 with worm-shaped slit 305 can be easily done using slit 323. Retaining part 306 has a head portion which projects at a right angle to an axial direction of tubular body 304 and the rear portion is inclined to the axial direction. Engaging retaining part 306 with worm-shaped way 305 can be easily performed and detachment of retaining part 306 from worm-shaped way 305 cannot be easily performed. Even if tubular cap 314 is pulled out a little roughly, tubular lead pipe holder 307 is left on lead pipe 308 and retaining part 308 does not come off worm-shaped way 305. This is because when tubular lead pipe holder 307 is set on tubular body 304, it is not yet inserted into outer sleeve 303. Therefore tubular body 304 can be easily expanded so that tubular lead pipe holder 307 can be comparatively easily set. On the other hand, after tubular lead pipe holder 307 has been set, an inner wall of outer sleeve 303 prevents tubular body 304 from expanding and also prevents retaining part 306 from slipping out of the worm-shaped way.

If slipping out of retaining part 306 from worm-shaped way 305 occurs, the tubular lead pipe holder prevents feeding of lead to lead pipe 308. Particular attention should be paid to this point.

Polygonal part 330 provided on the outer side of the forward end of a tubular lead pipe holder 307 inserted into polygonal part 329 provided on the inner surface of the outer surface by which tubular lead pipe holder 307 is movable in the axial direction and is locked in the turning direction against the inner surface of outer sleeve 303. However the present device does not need to be restricted to such a construction, for example, it may be a key groove and a key.

The inner surface of tubular body 304 is provided with a bearing part 9 of tubular lead pipe holder 307, and the corresponding rearward part of tubular body 304 is provided with axial slits 310. Stick-shaped object holder 313 is slidably inserted on inside walls on both sides of these two slits 310 so that holding pieces 312 holding stick-shaped object 311 are guided in both slits 310. Of course, in place of the holder for stick-shaped object 311, a cylindrical pipe may be used for holding stick-shaped object 311 as the stick-shaped object 311, an eraser, seal and the like can be used. In the drawing a stick-shaped object formed of an eraser is shown.

The holding pieces of stick-shaped object holder 313 are provided with projection 316 inserted in spiral groove 315 formed in the inner surface of tubular cap 314 brought into contact with the rear end of outer sleeve 303. The inside of tubular cap 314 is provided with an annular projection 317, and outer surface of tubular body 304 is provided with a retaining part 318 engaged with annular projection 317. The retaining part 318 is formed of projecting pieces 319 and stair or step 320 provided on tubular body 301.

Outer sleeve and tubular cap 314 have outside diameters of the same length and the rear end of the tubular body 304 is provided with an outside ring 321 brought into contact with tubular cap 314. Outside ring 321 acts as a stopper for stick-shaped holder 313.

In the above construction, when tubular cap 314 is turned in one direction, for example, counter-clockwise, projection 316 engages worm-shaped groove 315 of tubular cap 314 and comes to the forward end (a starting point) of spiral groove 315 so that stick-shaped object holder 313 can not be turned. Therefore tubular body 304 is turned through holder 313. Because retaining part 306 is inserted in a spiral slit 305 provided at the forward part of tubular body 304, and because a polygonal part 330 provided on the outer surface of the forward part of tubular lead pipe holder 307 is inserted into polygonal part 329 on the inner surface of the outer sleeve 303, tubular lead pipe holder 307 is movable in the axial direction and is locked in the turning direction. Therefore relative movement of retaining part 306 along spiral slit 305 makes tubular body 304 move backward so that a space corresponding to the knocking width is formed between outer sleeve 303 and tubular cap 314 and knocking is possible. In this condition, when the rear end of tubular body 304 is knocked, tubular cap 314, tubular lead pipe holder 307 and lead pipe 308 of writing shaft 302 can be moved forward so that lead 329 can be extended from head member 301.

When carrying the mechanical pencil, or when the mechanical pencil is not in use, tubular cap 314 is turned in the reverse direction, clockwise, so that outer sleeve 303 is brought into contact with tubular cap 314. Because the space corresponding to the knocking space between both of them does not exist, and also because outer sleeve 303 and the tubular cap have the same outside diameter, the external appearance can be attractive. In this condition, even if tubular cap 314 is turned clockwise, the space is not formed between tubular cap 314 and outer sleeve 303, and retaining part 306 of tubular lead pipe holder 307 is brought into contact with an end of worm-shaped way 305 so that tubular body 4 cannot be turned. Therefore turning the tubular cap clockwise makes stick-shaped object holder 313 move rearward along spiral groove 315 of tubular cap 314 so that only stick-shaped object 311 projects out of the rear end of the tubular body. When eraser 311 is used, as the space between outer sleeve 303 and tubular cap 314 can be eliminated, a knocking action cannot occur. Therefore, even if a strong force is applied to eraser 311, there is no possibility of the eraser retracting. Therefore smooth erasing is possible.

After eraser 311 is used, the eraser 311 held with holding pieces 312 of stick-shaped holder 313 can be drawn in by turning tubular cap 314 counter-clockwise in the same manner as in the case after the knocking operation is finished. Therefore, there is no possibility of eraser 311 being strained or broken and a well-formed design of the mechanical pencil is possible.

Further, as the turning direction of the eraser being used and the turning direction of the knocking action being performed are constructively, clearly distinguished, holding the product to precise tolerances is not required. On the other hand, from a user's point of view, operation becomes simpler. Therefore operation errors can be eliminated by putting on the mechanical pencil simple indications such as "knock" if the tubular cap is turned counter-clockwise and "an eraser is extended" if the tubular cap is turned clockwise so that the mechanical pencil can be easily used.

Figure 11:
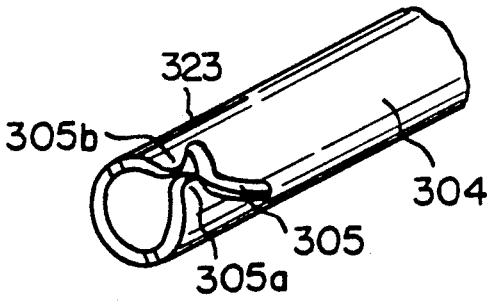
FIG. 11 is a perspective illustration showing another example of a worm-shaped part according to the invention.

FIG. 11 shows another example of a worm-shaped way for the present device. In this example, slit 305*a* is provided whose forward end is a continuation of worm-shaped slit 305. Slit 305*a* is provided with constricted part 305*b*. In this example, the worm-shaped part functions in the same manner as in the first example.

Stick-shaped object 311, may be a crayon or rouge.

As is understandable from the above description according to the present device, only when a knocking operation is performed, does the space corresponding to a knocking width form between outer sleeve 303 and tubular cap 314. Therefore as a space corresponding to the knocking width is not formed when carrying the mechanical pencil, or when the mechanical pencil is not in use, the external appearance can be attractive. Furthermore, as the space between the outer sleeve and the tubular cap cannot exist when the mechanical pencil is used, a knocking action cannot occur. Even if a strong force is applied on the stick-shaped object 311, there is no possibility of the stick-shaped object retracting, allowing smooth and sure use of stick-shaped object 311.

A fifth example according to the present device is illustrated with reference to FIGS. 12 to 15 hereinafter.

Figure 12:
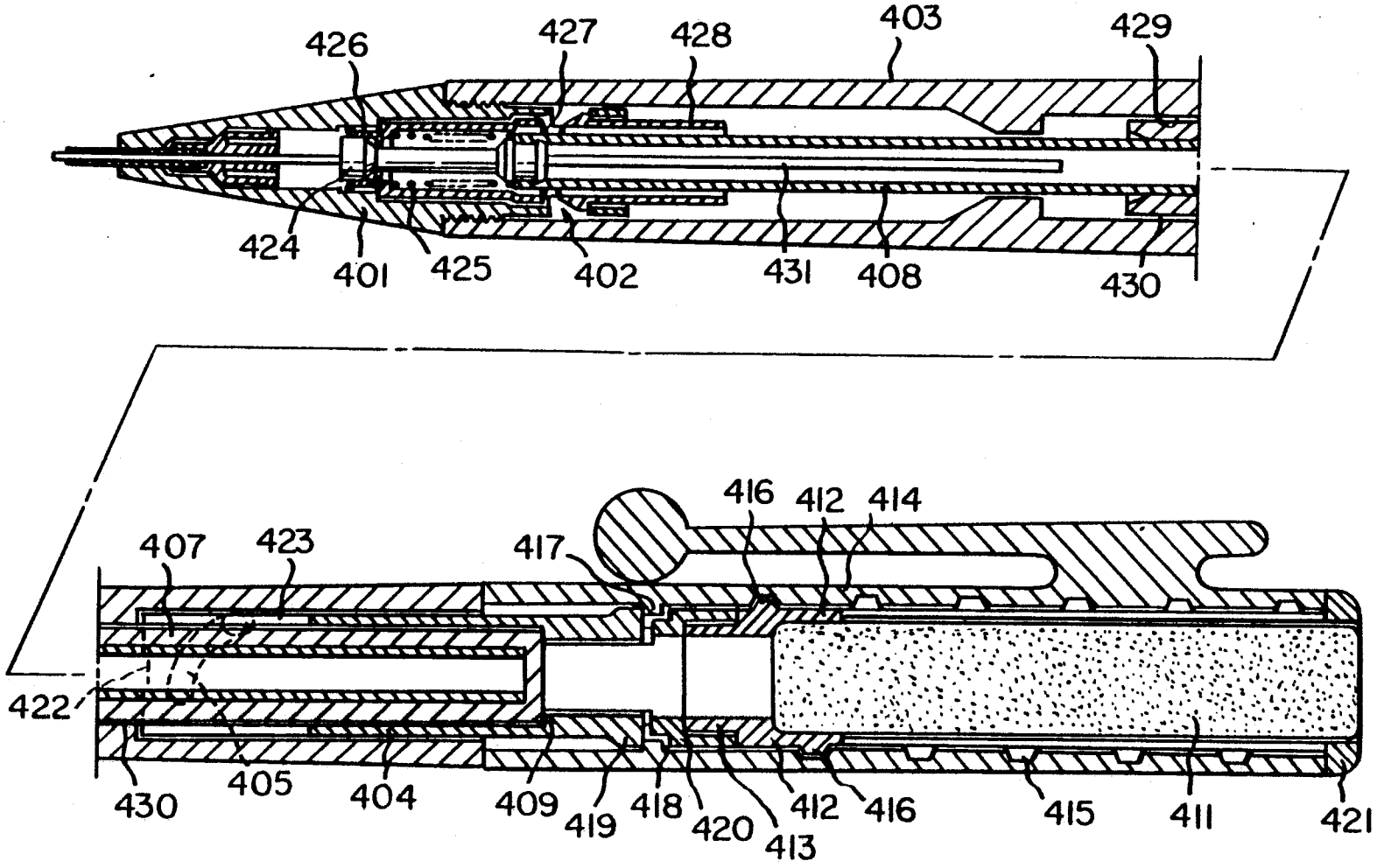
FIG. 12 is a section showing a fifth embodiment of a mechanical pencil according to the invention.
Figure 13:
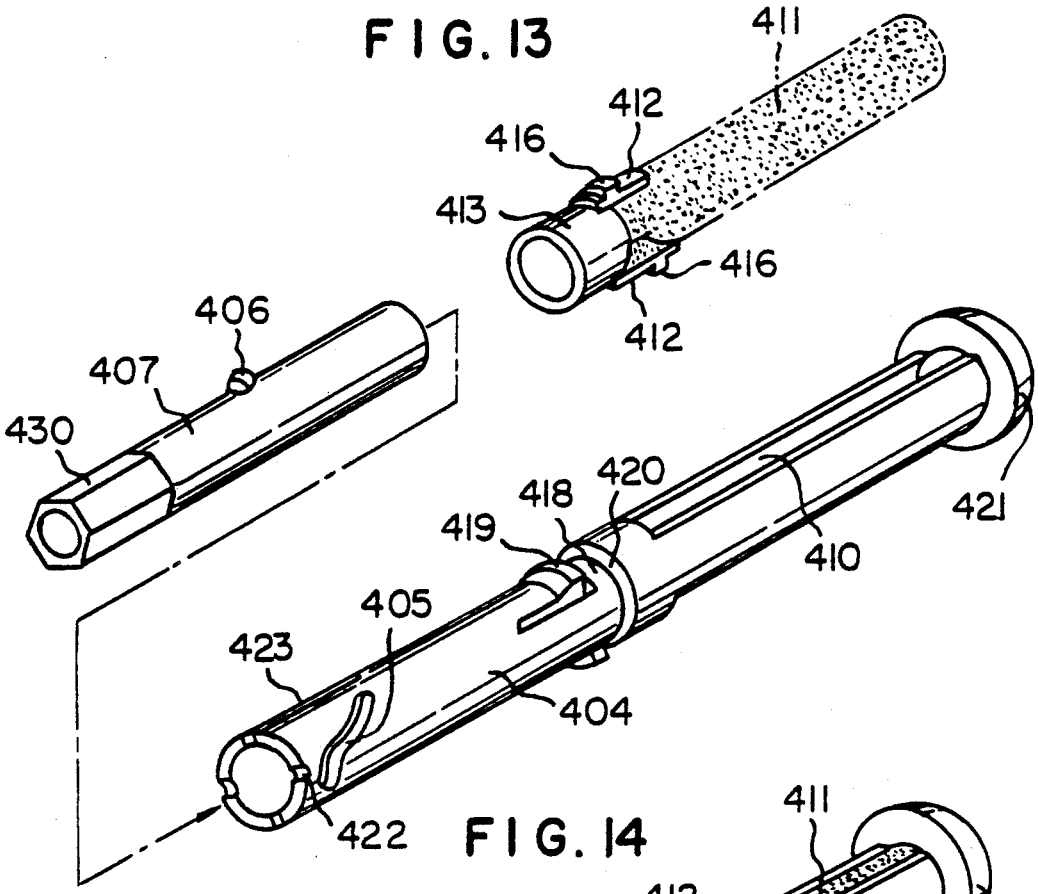
FIG. 13 is a partial exploded perspective illustration showing an essential part of the invention of FIG. 12.
Figure 14:
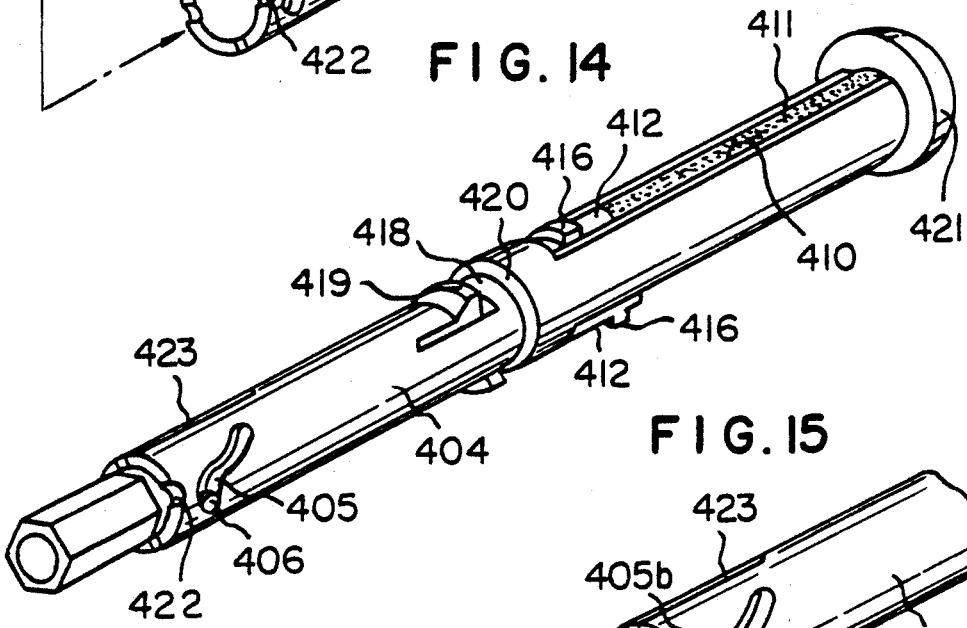
FIG. 14 is a perspective illustration showing the embodiment of FIG. 13 assembled.
Figure 15:
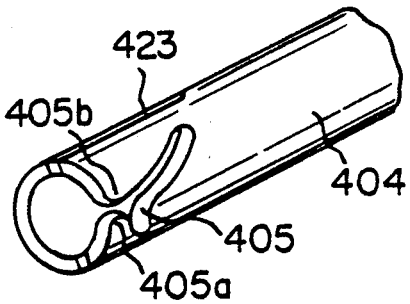
FIG. 15 is a perspective view showing another embodiment of a worm-shaped part according to the invention.

In FIG. 12, writing shaft 402 has a head member 401. Writing shaft 402 comprises chuck 424, a spring 425, chuck ring 426, sleeve with a cushion 427, and a lead pipe 408 connected to chuck 424. The writing shaft is provided in outer sleeve 403 by screwing the head part of outer sleeve 403 so that head member 1 projects.

The forward part of tubular body 404 is provided with a worm-shaped way 405, and tubular lead pipe holder 407 having on it outer surface retaining part 406 which engages with worm-shaped way 405 on lead pipe 408 of writing shaft 402. Herein worm-shaped way 405 may be a groove or a slit. In the drawing, a worm-shaped way formed of a slit is shown. Both ends of worm-shaped way 405 correspond to a starting point, and an end point respectively of retaining part 406. The forward end portion of tubular body 404 is provided, as occasion demands, with one or more slits 423 whose forward end(s) is (are) opened. Sliding recess 422 is provided at the forward end of the tubular body so that the engagement of retaining part 406 with worm-shaped slit 405 can be easily done by using slit 423. Retaining part 406 has a head portion which projects at a right angle to an axial direction of tubular body 404 and the rear portion which is inclined to the axial direction. Thereby engaging retaining part 406 with worm-shaped way 405 can be easily performed and detachment of retaining part 406 from worm-shaped way 405 cannot be easily performed. Even if tubular cap 414 is pulled out a little roughly, tubular lead pipe holder 407 is left on lead pipe 408, and retaining part 408 does not come off worm-shaped way provided with projection 416 inserted into spiral groove 415 formed in the inner surface of tubular cap 414 brought into contact with the rear end of outer sleeve 403 in the reverse direction to spiral slit 405. The inside of tubular cap 414 is provided with an annular projection 417, and the outer surface of tubular body 404 is provided with retaining part 418 engaging the annular projection 417. Retaining part 418 is formed on projecting pieces 419 provided on tubular body 401 and stair or step 420.

Outer tubular cap 414 at the rear end of tubular body 404 is provided with an outside ring 421 brought into contact with tubular cap 414 having outside diameters the same. Outside ring 421 acts as a stopper for stick-shaped holder 413.

In the above construction, when the tubular cap 414 is turned in one direction, for example clockwise, the projection 416 engaged with worm-shaped groove 415 of tubular cap 414 moves to the forward end (a starting point) of spiral groove 415 so that stick-shaped object holder 413 can not be turned. Therefore tubular body 404 turns through holder 413. Because retaining part 406 is inserted in spiral slit 405 provided at the forward part of tubular body 404, and because polygonal part 430 provided on the outer surface of the forward part of tubular lead pipe holder 407 is inserted into polygonal part 429 provided on the inner surface of outer sleeve 403, tubular lead pipe holder 407 is movable in the axial direction and is locked in the turning direction. Therefore relative movement of retaining part 406 along spiral slit 405 makes tubular body 404 move backward so that a space corresponding to the knocking width forms between outer sleeve 403 and tubular cap 414 and knocking becomes possible. In this condition, when the rear end of tubular body 404 is knocked, tubular cap 414, tubular lead pipe holder 407 and lead pipe 408 of writing shaft 402 can be moved forward so that lead 429 can be extended from head member 401.

When carrying the mechanical pencil, or when the mechanical pencil is not in use, tubular cap 414 is turned in the reverse direction, that is counter-clockwise, so that outer sleeve 403 is brought into contact with tubular cap 414. Because the space corresponding to the knocking space between both of them now does not exist, and also outer sleeve 403 and the tubular cap have the same outside diameter, the external appearance can be attractive. By further turning the tubular cap in the same direction retaining part 406 of tubular lead pipe holder 407 is brought into contact with an end of worm-shaped way 405 so that tubular body 404 cannot be turned. Therefore further turning of the tubular cap makes stick-shaped object holder 413 move rearward along spiral groove 415 of tubular cap 414 so that only stick-shaped object 11 can project out of the rear end of the tubular body. When eraser 411 is used, as the space between outer sleeve 403 and tubular cap 414 can be eliminated by turning tubular cap 414 in the reverse direction (counter-clockwise), a knocking action cannot occur. Therefore, even if a strong force is applied to eraser 411, there is no possibility of the eraser retracting. Therefore smooth erasing is possible. However, in this case, in the state when a space exists between outer sleeve 403 and tubular 414, without turning tubular cap 414 in the reverse direction, eraser 411 may be used.

After eraser 411 held with holding pieces 412 of stick-shaped holder 413 is used, it can be drawn in by turning tubular cap 414 in the reverse direction to remove the space between tubular sleeve 403 and tubular cap 414 and thereafter further turning in the reverse direction. Therefore, there is no possibility of eraser 411 being strained and a well-formed design of the mechanical pencil is possible.

FIG. 5 shows an another example of the worm-shaped way in the present device. In this example, slit 405*a* has a forward end that continues to worm-shaped slit 405. Slit 405*a* is provided with constricted part 405*b*. In this example, the worm-shaped part functions in the same manner as in the first example.

For stick-shaped object 411, objects such as seal, crayon, or rouge may be used.

As is understandable from the above description, according to the present device, only when a knocking operation is performed, can the space corresponding to a knocking width be formed between outer sleeve 403 and tubular cap 414. Therefore as a space corresponding to the knocking width is not formed when carrying the mechanical pencil, or when the mechanical pencil is not in use, the external appearance can be attractively formed. Furthermore, as the space between the outer sleeve and the tubular cap cannot exist when the mechanical pencil is used, a knocking action cannot occur. Even if a strong force is applied to stick-shaped object 411, there is no possibility of the stick-shaped object retracting, thus allowing smooth and sure use of stick-shaped object 411.

Figure 17:
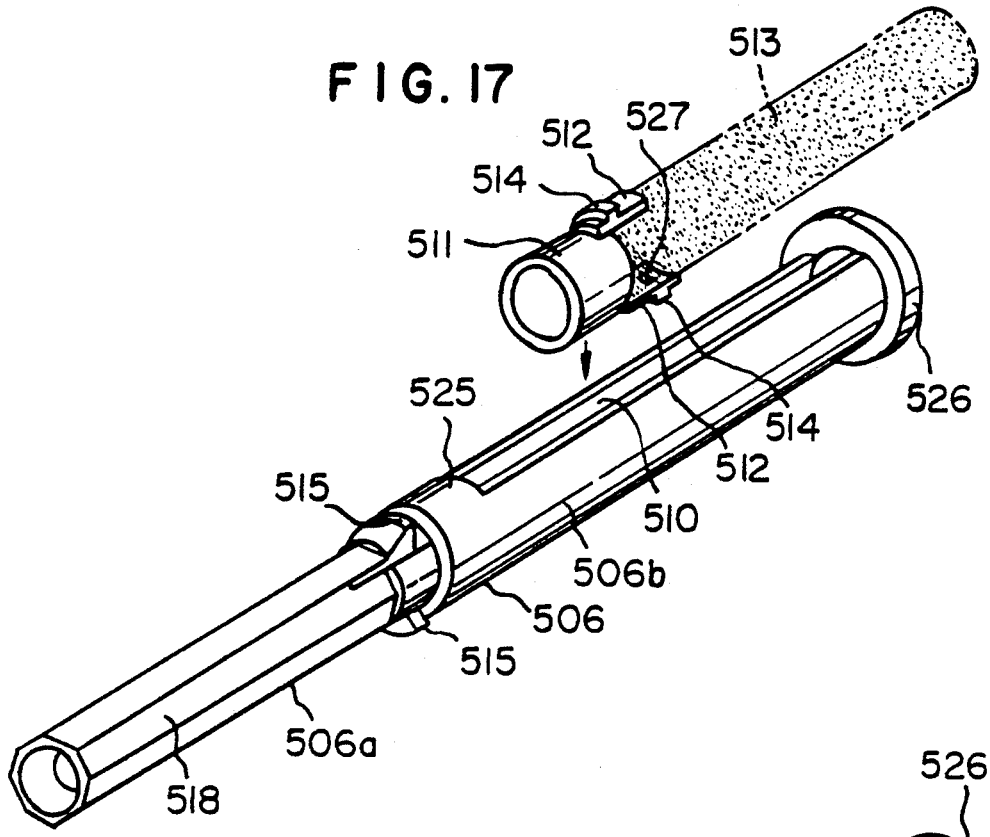
FIG. 17 is a partial exploded perspective illustration of the embodiment of FIG. 16.
Figure 18:
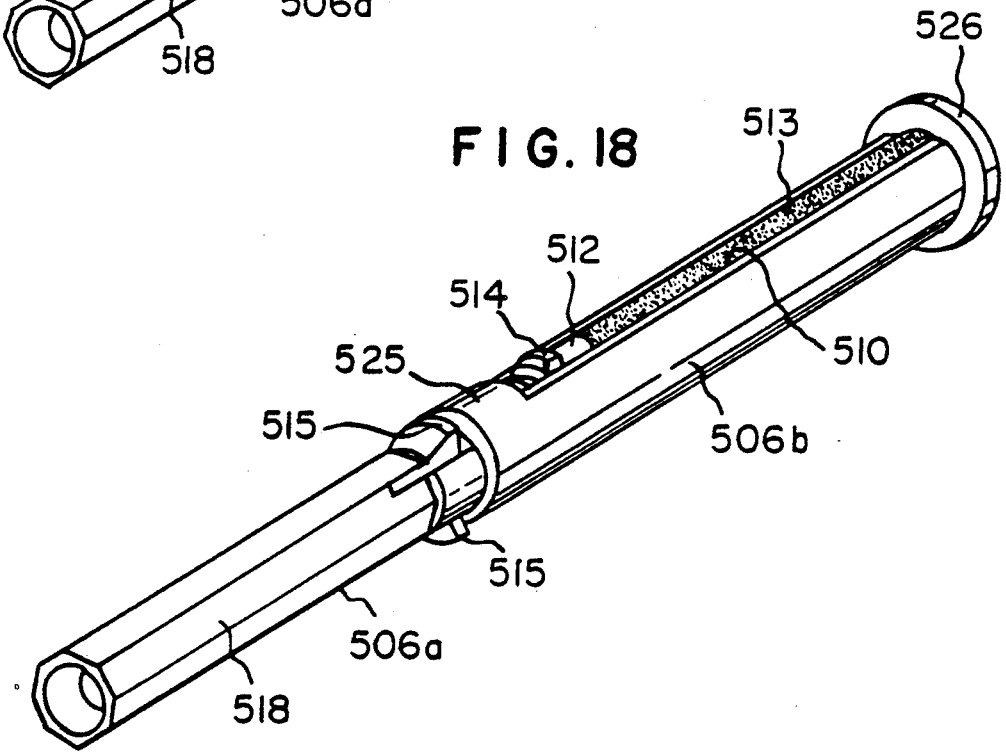
FIG. 18 is a perspective section view showing the stick-shaped object holder and eraser inserted into a slit of a tubular body according to the invention.

A sixth example according to the present device is illustrated with reference to FIGS. 16 to 18 hereinafter.

In the drawings, writing shaft 502 comprises chuck 521, spring 520, chuck ring 523, sleeve 524 having a pushing part 524*a*, and lead container 508 connected with chuck 521. Writing shaft 502 is provided in outer sleeve 503 by screwing head part of outer sleeve 503 to a position with head member 501 projected out of outer sleeve 506.

Figure 19:
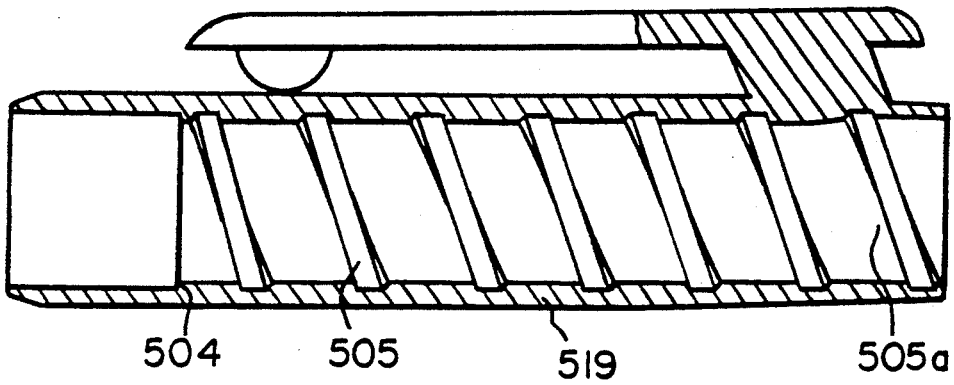
FIG. 19 is a vertical section of the tubular cap according to the invention.

Tubular cap 519 having a forward inner surface is provided with a stair or step 504 while rearward inner surface is provided with spiral groove 505. The inside diameter 505*a* at the rear part of spiral groove 505 are enlarged (refer to FIG. 19).

Numeral 506 designates a tubular body inserted into cap 519 from its rear end. On the outer surface of tubular body 519 nearly in the center thereof, projecting holder 515 formed by cutting is retained on stair or step 504 of tubular cap 519. Similarly a bearing part brought into contact with lead container 508 of writing shaft 502, for example, a bearing plate 509 is provided inside forward part 406*a* of tubular body 506.

A rear inner surface of outer sleeve 503 is formed with polygonal part 517 while an outer periphery of forward part 506*a* of tubular body 506 is formed with polygonal part 518 inserted into polygonal part 517. Accordingly, the forward part 506*a* of tubular body 506 is movable in the axial direction and is locked in the turning direction against the rear part of the outer sleeve. Means for locking forward part 506*a* of tubular body 506 however, so as to be movable in the axial direction does not need to be restricted to means with polygonal parts parts 517, 518, for example a key groove and key are possible.

Slits 510 are formed in the corresponding parts of rear part 506*a* of tubular body 506. Into slits 510, two holding pieces 512 of eraser receiver 511 are slidably inserted and directed rearward. Eraser 513 is held between the two holding pieces 512. Projection 514 provided on holding pieces 512 is inserted into spiral groove 505 of tubular cap 519. Annular stoppers 525, 526 of eraser receiver 511 are formed at a forward part and a rearward part of slits 506. Therefore eraser receiver 511 can be moved in the axial direction until eraser 511 is brought into contact with annular stoppers 525,526 at the forward and rear parts of slit 506.

Figure 20A:
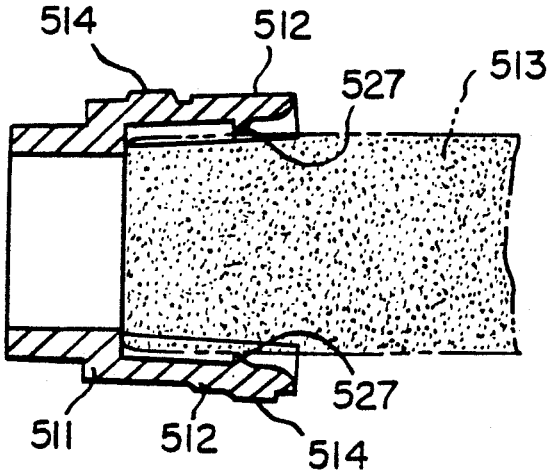
FIG. 20 (*a*) and (*b*) respcctively show a sectional view and a right side elevation of the stick-shaped object holder according to the invention.
Figure 20B:
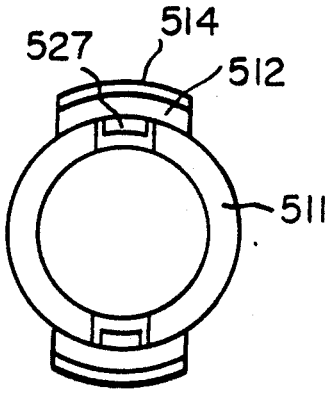

Each holding piece 512 of stick-shaped object holder 511 is slidably inserted into two slits 510 of the tubular body and is slightly curved outward as shown in FIG. 20(*a*). The two holding pieces 512 are deformed by the large inside diameter portion 505*a* of the rear part of spiral groove 505 in tubular cap 519 so that eraser 513 can be released from the two holding pieces 512. As the stick-shaped object holder 511 is moved forward from this position the two holding pieces 512 are deformed inward so that eraser 513 is held.

A method of assembling the mechanical pencil having the above construction according to the device is illustrated hereinafter.

First, as both sides of slit 510 of tubular body 506 are bent toward the outer side, stick-shaped object holder 511 is inserted from slit 510 so that both holding pieces 512 are directed toward the rearward portion, and both holding pieces 508 are slidably inserted in both slits 506. Then, eraser 513 is inserted from the rear end of tubular body 506 so as to be held by both holding pieces. Tubular body 506 is inserted from the rear end of tubular cap 519 whereby projecting pieces 515 are bent inward and go over stair or step 504 of tubular cap 519, and thereafter are retained in stair or step 504.

Holding of eraser 513 with both holding pieces 512 may be carried out after tubular body 506 is attached to tubular cap 519. When stick-shaped object holder 511 is located at the large inside diameter portion 505*a* at the rear part of spiral groove 505 and the two holding pieces 512 are opened, eraser 513 is inserted in two holding pieces 512. Then as the stick-shaped object holder 511 moves forward, eraser 513 is held by holding pieces 512. When attachment of tubular body 506 to tubular cap 519 is completed, annular stopper 526 of tubular body 506 is brought into contact with the rear end of tubular cap 510. Of course the sizes of parts should be determined so that the above state may be obtained.

Thereafter, polygonal part 518 provided on the outer surface of forward part 506*a* of tubular body 506 is inserted into polygonal part 517 provided on the rearward inner surface, thereby completed the assembly of the mechanical pencil. In this case, it must be noted that the insertion is tight enough so that tubular body 506 does not slip out of the rear portion of outer sleeve 503.

Then, the function of the eraser receiver according to the device is illustrated.

Figure 16:
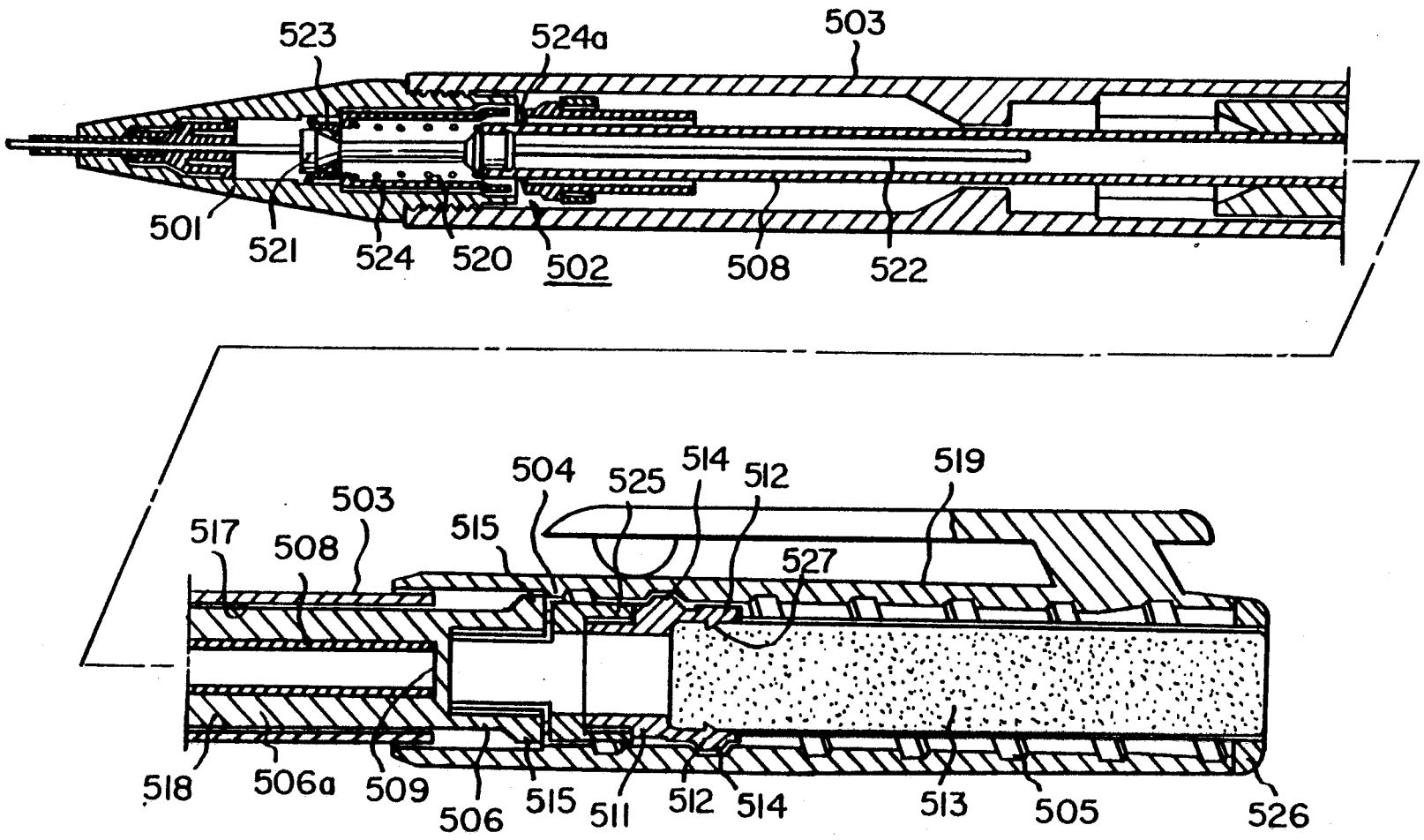
FIG. 16 is a vertical section showing a sixth embodiment of a mechanical pencil according to the invention.

When eraser 513 is not in use, as shown in FIG. 16, stick-shaped object holder 511 is brought into contact with annular stopper 525 of the forward part of tubular body 506, and the top of eraser 513 just coincides with the end of annular stopper 526 on the rear part of tubular body 505.

In this condition, when tubular cap 519 is turned, because forward part 506*a* of tubular body 506 is movable in the axial direction and is locked in the turning direction against the rearward part of outer sleeve 503, and the projection 514 provided on the holding piece 512 of the stick-shaped object holder 511 is inserted into spiral groove 505 of tubular cap 519, stick-shaped holder 511 is moved in the axial direction while being guided along both slits 510 of tubular body 506. Holding pieces 512 are inserted so that eraser 513 is held in stick-shaped object holder 511 and can be drawn in and extended out of tubular body 506 according to the direction turned.

Further, when the rear end of tubular body 506, lead container 508, is brought into contact with bearing plate 509, tubular cap 519 can be moved forward or rearward so that lead 522 can be drawn out of head member 501 against force of spring 520 by opening and shutting of chuck 521 as with known mechanical pencils.

Extending eraser 513 can be performed by turning tubular cap 519 to an amount equal to the worn out eraser whereby eraser holder 507 can be moved in the axial direction, or the right direction as in the example shown in the drawings. After the eraser has been used, turning in the reverse direction so that stick-shaped holder 511 is moved in the left direction, draws eraser 513 in.

When eraser 513 is completely consumed, stick-shaped object holder 511 is moved backward. Two holding pieces 512 of stick-shaped holder 512 deform outward, because the inside diameter 505*a* is larger. Therefore eraser 513 is released from the holding pieces so that the eraser can be easily taken from between two holding pieces 512. When tubular cap 519 is turned to move forward the stick-shaped object holder, projection 514 engaging spiral groove 505 leaves the large inside diameter part 505*a* of the rear part of the spiral groove, and holding pieces 512 are held by the tubular cap, thus holding eraser 513. Further, as shown in FIGS. 16 and 17, the inner surface may be provided with projection 527 which cut into eraser 513.

In this device, a stick-shaped object 513, such as a lead, crayon, crayon pastel, chalk, rouge, eyebrow pencil lead and the like can be used instead of the eraser.

As above-mentioned, according to the device, stick-shaped holder 511 can be moved in an axial direction by turning tubular cap 519 against outer sleeve 503 and can be drawn in and extended out of tubular body 506 according to the direction of turning. Therefore when the stick-shaped object is used, the eraser can be extended to the necessary amount so that the stick-shaped object can be used while, when the eraser is not in use, stick-shaped object 513 can be drawn in. Thus drawing in and extending the stick-shaped object 513 can be simply performed. Therefore, the usual troublesome effort does not need to be repeatedly carried out. Further the number of parts are few, and the mechanical pencil according to the device can be produced at a low price. Further because holding pieces 512 are opened when stick-shaped object 511 is located at the large inside diameter part 505*a* of the rear part of the spiral groove 505 provided in tubular cap 519. Exchange of a stick-shaped object can be easily performed without the stick-shaped objects falling out during use of the mechanical pencil.

I claim:

1. A writing tool comprising; an outer sleeve; a writing shaft having a head member on one end and a container being inserted in said outer sleeve; a tubular cap mounted on said outer sleeve; said tubular cap having a spiral shaped groove on an inner surface thereof extending from a stepped portion at one end of said tubular cap to a portion having a larger inside diameter at the other end of said tubular cap; a tubular body in said outer sleeve having a bearing surface engaging an end of said container on said writing shaft; said tubular body being axially movable and locked against rotational movement by means on an inner surface of said outer sleeve; an elongated slit in said tubular body; a stick-shaped object holder being inserted in said tubular body and having a projection engaging said elongated slit; said elongated slit allowing axial movement of said stick-shaped object holder while preventing rotational movement; said projection engaging said spiral groove on the inside surface of said tubular cap for axial movement when said tubular cap is rotated.

2. A writing tool according to claim 1 including ring shaped stopper means on the end of said tubular body to prevent said stick-shaped object holder and container from coming out of said outer sleeve.

3. A writing tool according to claim 1 in which said stick-shaped object holder has deformable holding pieces constructed to be deformed inward to grip said stick-shaped object when installed in said spiral groove.

4. A writing tool according to claim 3 in which at least one of said deformable holding pieces has a gripping projecting on an inner surface constructed to penetrate and hold said stick-shaped object.

* * * * *